US005113814A

United States Patent [19]

Suga et al.

[11] Patent Number: 5,113,814

[45] Date of Patent: May 19, 1992

[54] VALVE TIMING CONTROL SYSTEM FOR INTERNAL COMBUSTION ENGINE WITH ENHANCED RESPONSE CHARACTERISTICS IN ADJUSTMENT OF VALVE TIMING

[75] Inventors: Seiji Suga; Shoji Morita, both of Kanagawa, Japan

[73] Assignee: Atsugi Unisia Corporation, Kanagawa, Japan

[21] Appl. No.: 647,569

[22] Filed: Jan. 28, 1991

[30] Foreign Application Priority Data

Jan. 30, 1990 [JP] Japan ..... 2-20051

[51] Int. Cl.[5] ..... F01L 1/34

[52] U.S. Cl. ..... 123/90.17; 123/90.31; 464/2

[58] Field of Search ..... 123/90.15, 90.17, 90.31; 464/1, 2

[56] References Cited

U.S. PATENT DOCUMENTS 4,601,266 7/1986 Oldfield et al. ..... 464/2
4,627,825 12/1986 Bruss et al. ..... 123/90.17
4,858,572 8/1989 Shirai et al. ..... 123/90.15
4,889,086 12/1989 Scapecchi et al. ..... 123/90.31

FOREIGN PATENT DOCUMENTS 3619956 12/1987 Fed. Rep. of Germany .
227507 9/1990 Japan ..... 123/90.17
2120320 11/1983 United Kingdom ..... 123/90.17

*Primary Examiner*—E. Rollins Cross
*Assistant Examiner*—Weilun Lo
*Attorney, Agent, or Firm*—Bachman & La Pointe

[57] ABSTRACT

A valve timing control system includes an engine revolution synchronous element driven in synchronism with engine revolution and a camshaft synchronous element rotating together with a camshaft. A phase adjusting means disposed between the engine revolution synchronous element and the camshaft synchronous element. The phase adjusting means includes movable gear member which is thrustingly movable to determine phase relationship between the engine revolution synchronous element and the camshaft synchronous element, and a hydraulic means for driving the movable gear member to a desired position. The hydraulic means is connected to a fluid pressure source via a hydraulic circuit. A check valve is disposed in the hydraulic circuit for preventing surge flow of the pressurized fluid from the hydraulic means toward the fluid pressure source.

5 Claims, 1 Drawing Sheet

VALVE TIMING CONTROL SYSTEM FOR INTERNAL COMBUSTION ENGINE WITH ENHANCED RESPONSE CHARACTERISTICS IN ADJUSTMENT OF VALVE TIMING

BACKGROUND OF THE INVENTION

1. Field of the Invention

The present invention relates generally to a valve timing control system for an internal combustion engine for adjusting open and close timing of intake and/or exhaust valve depending upon engine driving condition. More specifically, the invention relates to a valve timing control system for adjusting valve open and/or close timing with assurance of smooth thrusting motion of a phase adjusting means.

2. Description of the Background Art

One typical construction of the conventionally known valve timing control system has been illustrated in the U.S. Pat. No. 4,535,731. In the disclosed construction, a camshaft carries a camshaft synchronous rotary member. On the other hand, a timing sprocket is mechanically connected to a crankshaft via a timing chain for rotation in synchronism with engine revolution. An intermediate gear member of generally cylindrical construction is disposed between the timing sprocket and the camshaft synchronous rotary member. The intermediate gear member has helical gear teeth formed on at least one of the inner and outer periphery thereof. The intermediate gear member is axially shiftable by a hydraulic means for causing phase shift between the crankshaft and the camshaft.

In the shown construction, the intermediate gear member is shiftable between a first and initial position and a second shifted position. At the first position of the intermediate gear member, the phase relationship between the camshaft and the crankshaft is maintained at initial phase relationship. When the intermediate gear member is shifted to the shifted position, the phase relationship is varied to advance the valve timing relative to the engine revolution.

Though such prior proposed valve timing control system is successful to improve the engine driving performance in certain aspect, however, performance realized in the prior proposed system was not satisfactorily high, particularly in terms of response characteristics. Namely, the torsional torque exerted on the camshaft cannot be maintained constant. Rather, the rotational torque at the camshaft periodically fluctuates upon opening and closing of the intake valve and the exhaust value. Such fluctuation of the rotational torque on the camshaft will be transmitted to the intermediate gear member. This fluctuating rotational torque can serve as resistance against shifting motion of the intermediate gear member to cause inching motion of the intermediate gear member. This clearly slows down shifting speed of the intermediate gear member to degrade response characteristics in adjusting the phase relationship of the camshaft relative to the engine revolution cycle.

SUMMARY OF THE INVENTION

Therefore, it is an object of the present invention to provide a valve timing control system which can avoid influence of torque fluctuation at a camshaft and thus can provide enhanced response characteristics in adjustment of phase relationship of the camshaft relative to engine revolution cycle.

In order to accomplish aforementioned and other objects, a valve timing control system, according to the present invention, includes an engine revolution synchronous element driven in synchronism with engine revolution and a camshaft synchronous element rotating together with a camshaft. A phase adjusting means is disposed between the engine revolution synchronous element and the camshaft synchronous element. The phase adjusting means includes movable gear member which is thrustingly movable to determine phase relationship between the engine revolution synchronous element and the camshaft synchronous element, and a hydraulic means for driving the movable gear member to a desired position. The hydraulic means is connected to a fluid pressure source via a hydraulic circuit. A check valve is disposed in the hydraulic circuit for preventing surge flow of the pressurized fluid from the hydraulic means toward the fluid pressure source.

According to one aspect of the invention, a valve timing control system for an automotive vehicle, comprises:

an engine revolution synchronous rotary element rotatingly driven in synchronism with engine revolution;

a camshaft for driving intake and/or exhaust valve of an induction system of the engine;

a camshaft synchronous rotary element rotating in sychronism with engine revolution;

a phase adjusting means disposed between the engine revolution synchronous rotary element and the camshaft synchronous rotary element for adjusting rotational phase relationship between the rotary elements for adjusting rotational phase of the camshaft relative to engine revolution system;

a control means associated with the phase adjusting means, for actuating the phase adjusting means, for shifting the phase adjusting means between a minimum advance position corresponding to a predetermined minimum advanced phase of the camshaft relative to the engine revolution cycle and a maximum advance position corresponding to a predetermined maximum advanced phase of the camshaft relative to the engine revolution cycle, the control means including a pressure chamber oriented adjacent the phase adjusting means for exerting fluid force to the phase adjusting means, a fluid pressure source connected to the pressure chamber via a fluid circuit and a valve means disposed within the fluid circuit, the valve means operable for increasing and decreasing fluid pressure in the pressure chamber; and means for blocking surge flow of pressurized fluid in the fluid circuit.

The surge flow blocking means may be active while the valve means is operated to increase the fluid pressure in the pressure chamber.

According to another aspect of the invention, a valve timing control system for an automotive vehicle, comprises:

an engine revolution synchronous rotary element rotatingly driven in synchronism with engine revolution;

a camshaft for driving intake and/or exhaust valve of an induction system of the engine;

a camshaft synchronous rotary element rotating in synchronism with engine revolution;

a phase adjusting means disposed between the engine revolution synchronous rotary element and the camshaft synchronous rotary element for adjusting rotational phase relationship between the rotary elements for adjusting rotational phase of the camshaft relative to engine revolution system, the phase adjusting means being thrustingly drivable between a first minimum advance position and a second maximum advance position;

a control means associated with the phase adjusting means, for actuating the phase adjusting means, for shifting the phase adjusting means between a minimum advance position corresponding to a predetermined minimum advanced phase of the camshaft relative to the engine revolution cycle and a maximum advance position corresponding to a predetermined maximum advanced phase of the camshaft relative to the engine revolution cycle, the control means including a pressure chamber oriented adjacent the phase adjusting means for exerting fluid force to the phase adjusting means, a fluid pressure source connected to the pressure chamber via a fluid circuit and a valve means disposed within the fluid circuit, the valve means operable for increasing and decreasing fluid pressure in the pressure chamber; and check valve means for permitting fluid flow directed to the pressure chamber and blocking surge flow of pressurized fluid in the fluid circuit.

The control means may include an electromagnetic actuator associated with the valve means for selectively establishing and blocking fluid communication between the pressure chamber and a drain path.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment, but are for explanation and understanding only.

In the drawings:

Figure 1:
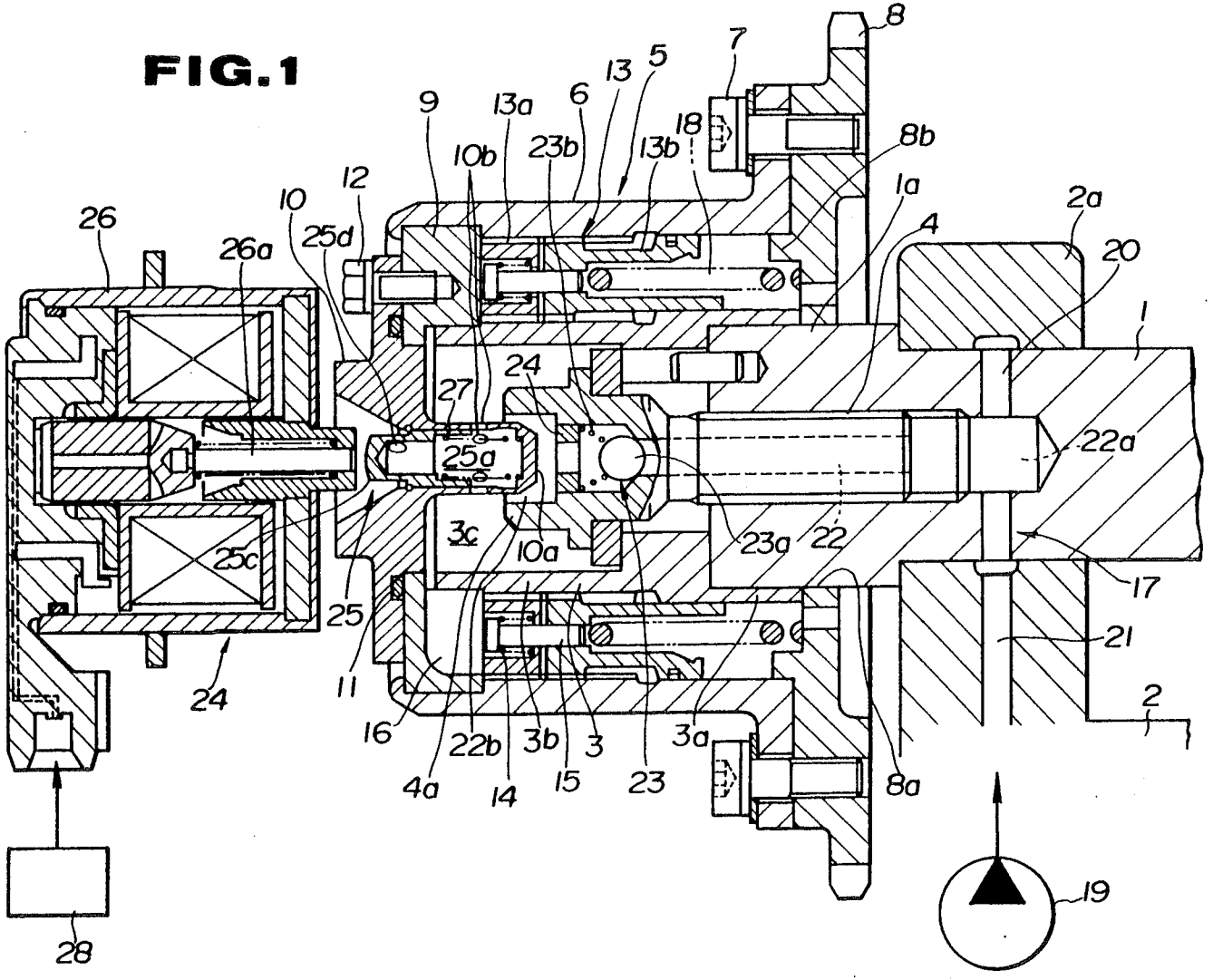

The sole FIGURE is a section of the preferred embodiment of a valve timing control system according to the present invention.

DESCRIPTION OF THE PREFERRED EMBODIMENT

Referring now to the drawings, the preferred embodiment of a valve timing control system, according to the present invention, is applied for double over-head camshaft (DOHC) type internal combustion engine. However, the similar construction with minor modification if required, is applicable even for single overhead camshaft (SOHC) type internal combustion engine. As show in the drawing, a camshaft 1 is rotatably supported by a cam bearing 2*a* of a cylinder head 2. An essentially cylindrical rotary member 3 is secured on the axial end portion 1*a* of the camshaft 1, which cylindrical member will be hereafter referred to as "inner cylindrical member". The cylindrical rotary member 3 is fixed onto the axial end 1*a* of the camshaft 1 by means of a fastening bolt 4. A timing sprocket assembly 8 is connected to a crankshaft (not shown) via a timing chain for driving in synchronism with the engine revolution. A cylindrical member 6 is rigidly fixed to the timing sprocket 5 for rotation therewith. The rotary cylindrical member 6 is formed with internal gear teeth, which cylinder member will be hereafter referred to as "outer cylindrical member".

The inner cylindrical member 3 had a base section 3*a* rigidly connected to the axial end 1*a* of the camshaft 1. On the other hand, the cylindrical rotary member 3 is formed with external gear teeth. The outer cylindrical member 6 has greater axial length than that of the section 3*b* of the cylindrical rotary member 3. The timing sprocket assembly 5 comprises the outer cylindrical member 6 and a gear section 8 which is rigidly fixed to the cylindrical member by means of fastening bolts 7. The gear section 8 has a center opening 8*a*, through which the axial end 1*a* of the camshaft 1 is inserted for rotatably supporting the timing sprocket assembly. An annular ring 9 is clamped on the inner periphery of the outer cylindrical member 6 in the vicinity of the axial end. A retainer plate 10 is fixed to the axial end of the outer cylindrical member 6 together with a seal ring 11 by means of fastening bolts 12.

Between, inner and outer cylindrical members 3 and 6, a cylindrical gear assembly 13 which serves as an intermediate gear, is disposed. The cylindrical gear assembly 13 comprises a mutually separated two gear elements 13*a* and 13*b*. The gear elements 13*a* and 13*b* are connected to each other by means of a spring 14 and a connecting pin 15. On both of the inner and outer periphery of the gear elements 13*a* and 13*b*, spiral gear teeth are formed. The inner spiral gear teeth on the inner periphery of the cylindrical gear assembly 13 meshes with the gear teeth formed on the outer periphery of the inner cylindrical member 3*b*. On the other hand, the outer spiral gear teeth on the outer periphery of the cylindrical gear assembly 13 meshes with the inner gear teeth formed on the inner periphery of the outer cylindrical member 6. The axial end of the gear element 13*a* remote from the gear element 13*b*, opposes with the annular ring 9 so that axial motion toward left in FIG. 1 is restricted by abutting the axial end onto the annular ring. On the other hand, the axial end of the gear element 13*b* remote from the gear element 13*a* opposes an annular projection 8*b* axially extending from the radial section of the gear member 8. Therefore, the motion stroke of the cylindrical gear member 13 toward the right is restricted by abutting the axial end of the gear element 13*b* onto the annular projection 8*b*.

The cylindrical gear assembly 13 is driven axially in back and forth by means of a drive mechanism. The drive mechanism includes a hydraulic means for driving the cylindrical gear assembly 13 in backward (toward right in FIG. 1). The hydraulic means comprises a pressure chamber 16 defined between the annular ring 9 and the gear element 13*a*. In the shown embodiment, the pressure chamber 16 is defined by forming groove on the annular ring. The pressure chamber 16 is connected to a fluid pump 19 as a pressurized fluid source, via a hydraulic circuit 17. On the other hand, a mechanical coil spring 18 is disposed between the radial section of the gear member 8 and the gear element 13*b*.

The hydraulic circuit 17 includes a supply path 21 extending through the cam bearing 2*a* of the cylinder head 2. The supply path 21 is communicated with radial path 20 via annular groove formed on the inner periphery of the cam bearing. The radial path 20 is communicated with an axial path 22 via an axial bore 22*a* defined in the bottom portion of the threaded bore to which the fastening bolt 4 for securing the inner cylindrical member 3 onto the axial end of the camshaft. The axial path 22 is communicated with an axial opening 22*b* formed through the fastening bolt 4. The axial opening 22*b* opens to the recess formed on the bolt head 4*a*. The recess of the bolt head 4*a* is communicated with a chamber 3*c* defined in the inner cylindrical member 3. The chamber 3*c* is communicated with the pressure chamber 16.

In desired, an electromagnetic flow control valve may be provided in the hydraulic circuit 17. In such case, the flow control valve may selectively establish fluid communication between the fluid pump 19 and one of the supply line 21 and a drain line.

A pressure control mechanism 24 is provided for controlling fluid pressure in the pressure chamber 16. The pressure control mechanism 24 comprises a bottomed cylindrical extension 10*a* extending from the inner periphery of the retainer plate 10. A valve body 25 is disposed within the internal space of the cylindrical extension 10*a* for thrusting motion therein. The valve body 25 is associated with an electromagnetic actuator 26.

As shown in the drawing, the valve body 25 is movable for selectively establishing and blocking fluid communication between the chamber 3*c* and the interior space in the cylindrical extension 10*a* via a plurality of radial openings 10*b* oriented at circumferentially offset positions of the cylindrical extension 10*a*. The interior space of the extension 10*a* is communicated with the interior space 25*a* of the valve body 25. The interior space 25*a* is also communicated with the conical discharge outlet former though the retainer plate 10 via radial openings 10*b* while the valve body 25 is maintained at the initial position.

The outer end of the valve body 25 opposes a plunger 26*a* of the electromagnetic actuator 26. The electromagnetic actuator 26 is responsive to an electric control signal which is, in practice, ON/OFF signal. When the control signal is HIGH level (ON), the actuator 26 is energized to protrude the plunger 26*a* from the actuator housing to push the valve body 25 toward the right in the drawing. By shifting of the valve body 25 toward the right, the valve body closes radial openings 10*b* to block fluid communication between the chamber 3*c* and the interior space 25*a* of valve body 25. By this, the chamber 3*c* is blocked from fluid communication with the conical opening of the retainer plate 10. Therefore, at this time, the pressurized fluid supplied from the fluid pump 19 is introduced into the pressure chamber 16 for increasing the fluid pressure therein. On the other hand, when the control signal is LOW level (OFF), the actuator 26 is maintained in the deenergized state. In such condition, the valve body 25 is maintained at the initial position by the spring force of the coil spring 27. As a result, the radial openings 10*b* are held open to permit fluid communication between the chamber 3*c* and the interior space of the valve body 25.

An one-way check valve assembly 23 is provided at the outlet of the axial path 22 extending through the fastening bolt 4. The one-way check valve assembly 23 comprises a ball valve 23*a*, a valve spring 23*b* which exerts set force for the ball valve, and an annular spring seat member 24 rigidly secured on the inner periphery of the bolt head bore. The valve spring 23*b* normally bias the ball valve 23*a* toward the outlet of the axial path 22 for closing the outlet with a set force. The check valve assembly 23 is thus constructed responsive to the fluid flow from the axial path 22 to the chamber 3*c* overcoming the set force to open to permit fluid flow and block fluid flow from the chamber 3*c* to the axial path 22.

In the practical operation, the pressure control signal is maintained LOW level while the engine load is LOW. At this time, the LOW level pressure control signal is supplied to the actuator 26. Since the control signal supplied to the actuator 26 is maintained LOW level, actuator 26 is held deenergized. Therefore, the valve body 25 is maintained at the initial position to establish fluid communication between the chamber 3*c* and the interior space 25*a* of the valve body, and to establish fluid communication through the radial paths, 10*b*. Therefore, the pressurized fluid supplied from the fluid pump 19 is discharged through the discharge outlet of the retainer plate 10 to maintain the fluid pressure in the pressure chamber 16 at low level. Therefore, the cylindrical gear assembly 13 is maintained at the position seated on the ring member 9. At this position, magnitude of phase advance of the camshaft 1 relative to phase of the engine revolution is maintained minimum. Therefore, valve close timing becomes relatively late.

When the engine load is grown to HIGH, the pressure control signal becomes HIGH level to energize the actuator 26. By this, the valve body 25 is shifted to block fluid communication between the conical path and the chamber 3*c*. Therefore, the pressurized fluid is supplied to the pressurized fluid into the pressure chamber 16 to increase the fluid pressure. As a result, the fluid pressure in the pressure chamber 16 is further increased to fully shift the cylindrical gear member until the gear element 13*b* comes into contact with the annular projection 8*b*. The phase relationship of the camshaft relative to the timing sprocket thus becomes maximum advanced position.

During travel of the cylindrical gear assembly 13 from the minimum advance position to the maximum advance position, the cylindrical gear assembly 13 subjects torque fluctuation transmitted through the camshaft 1. Since the travel of the cylindrical gear assembly causes angular displacement of the cylindrical member by helical gear teeth meshing with the internal and external gear teeth of the outer and inner cylindrical rotary members 6 and 3, the rotational torque in the opposite direction to the direction of rotation of the cylindrical gear assembly during travel in the phase advancing direction may serve as resistance for travel thereof. However, since the one-way check valve 23 blocks the surge flow of the pressurized fluid back to the axial path 22. The fluid pressure in the pressure chamber 16 can be maintained high enough to maintain travel of the cylindrical gear assembly 13. Therefore, influence of the torque fluctuation input from the camshaft can be successfully avoided in adjusting phase relationship of the camshaft relative to the engine revolution.

While the present invention has been discussed in terms of the preferred embodiment of the invention, the invention can be embodied in various fashion. Therefore, the invention should not be understood as specified to the foregoing preferred embodiment but can be implemented in various constructions. Therefore, the present invention is to be appreciated to include all possible embodiments and modifications which can be embodied without departing from the principle of the invention as set out in the appended claims.

What is claimed is:

1. A valve timing control system for an automotive vehicle, comprising:

an engine revolution synchronous rotary element rotatingly driven in synchronism with engine revolution;

a camshaft for driving intake and/or exhaust valve of an induction system of the engine;

a camshaft synchronous rotary element rotating in synchronism with engine revolution;

a phase adjusting means disposed between said engine revolution synchronous rotary element and said camshaft synchronous rotary element for adjusting rotational phase relationship between said rotary elements for adjusting rotational phase of said camshaft relative to engine revolution;

a control means associated with said phase adjusting means, for actuating said phase adjusting means, for shifting said phase adjusting means between a minimum advance position corresponding to a predetermined minimum advanced phase of said camshaft relative to the engine revolution cycle and a maximum advance position corresponding to a predetermined maximum advanced phase of said camshaft relative to the engine revolution cycle, said control means including a pressure chamber oriented adjacent said phase adjusting means for exerting fluid force to said phase adjusting means, a fluid pressure source connected to said pressure chamber via a fluid circuit and a valve means disposed within said fluid circuit, said valve means operable for increasing and decreasing fluid pressure in said pressure chamber; and means positioned at the inlet of said pressure chamber for blocking surge flow of pressurized fluid in said fluid circuit.

2. A valve timing control system as set forth in claim 1, wherein said surge flow blocking means is active while said valve means is operated to increase the fluid pressure in said pressure chamber.

3. A valve timing control system for an automotive vehicle, comprising:

an engine revolution synchronous rotary element rotatingly driven in synchronism with engine revolution;

a camshaft for driving intake and/or exhaust valve of an induction system of the engine;

a camshaft synchronous rotary element rotating in synchronism with engine revolution;

a phase adjusting means disposed between said engine revolution synchronous rotary element and said camshaft synchronous rotary element for adjusting rotational phase relationship between said rotary elements for adjusting rotational phase of said camshaft relative to engine revolution, said phase adjusting means being thrustingly drivable between a first minimum advance position and a second maximum advance position;

a control means associated with said phase adjusting means, for actuating said phase adjusting means, for shifting said phase adjusting means between a minimum advance position corresponding to a predetermined minimum advanced phase of said camshaft relative to the engine revolution cycle and a maximum advance position corresponding to a predetermined maximum advanced phase of said camshaft relative to the engine revolution cycle, said control means including a pressure chamber oriented adjacent said phase adjusting means for exerting fluid force to said phase adjusting means, a fluid pressure source connected to said pressure chamber via a fluid circuit and a valve means disposed within said fluid circuit, said valve means operable for increasing and decreasing fluid pressure in said pressure chamber; and check valve means for permitting fluid flow directed to said pressure chamber and blocking surge flow of pressurized fluid in said fluid circuit, said check valve means positioned for minimizing volume of the fluid circuit between said pressure chamber and the check valve means.

4. A valve timing control system as set forth in claim 3, wherein said control means includes an electromagnetic actuator associated with said valve means for selectively establishing and blocking fluid communication between said pressure chamber and a drain path.

5. A valve timing control system for an automotive vehicle, comprising:

an engine revolution synchronous rotary element rotatingly driven in synchronism with engine revolution;

a camshaft for driving intake and/or exhaust valve of an induction system of the engine;

a camshaft synchronous rotary element rotating in synchronism with engine revolution;

a phase adjusting means disposed between said engine revolution synchronous rotary element and said camshaft synchronous rotary element for adjusting rotational phase relationship between said rotary elements for adjusting rotational phase of said camshaft relative to engine revolution;

a control means associated with said phase adjusting means, for actuating said phase adjusting means, for shifting said phase adjusting means between a minimum advance position corresponding to a predetermined minimum advanced phase of said camshaft relative to the engine revolution cycle and a maximum advance position corresponding to a predetermined maximum advanced phase of said camshaft relative to the engine revolution cycle, said control means including a pressure chamber positioned adjacent said phase adjusting means for exerting fluid source to said phase adjusting means, a fluid pressure source connected to said pressure chamber via a fluid circuit and a valve means disposed within said fluid circuit, said valve means operable for increasing and decreasing fluid pressure in said pressure chamber, said fluid circuit including a pressurized fluid supply line for supplying pressurized working fluid to said pressure chamber, part of said supply line extending axially through said camshaft; and means positioned in the vicinity of the axial end of said axially extending part of said supply line, for blocking surge flow of pressurized fluid from said pressure chamber back to said pressure source via said supply line.

* * * * *